US011802526B2

(12) United States Patent
Koga et al.

(10) Patent No.: US 11,802,526 B2
(45) Date of Patent: Oct. 31, 2023

(54) CANISTER DISPOSAL STRUCTURE AND THE VEHICLE INCLUDING SAME

(71) Applicant: Honda Motor Co., Ltd., Tokyo (JP)

(72) Inventors: Yuki Koga, Tokyo (JP); Chihiro Kambayashi, Tokyo (JP); Naoki Oka, Tokyo (JP); Kazuhiro Kobayashi, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 18/167,090

(22) Filed: Feb. 10, 2023

(65) Prior Publication Data

US 2023/0304459 A1 Sep. 28, 2023

(30) Foreign Application Priority Data

Mar. 25, 2022 (CN) ..... 202210299530.5

(51) Int. Cl.
*F02M 25/08* (2006.01)

(52) U.S. Cl.
CPC ..... *F02M 25/089* (2013.01); *F02M 25/0854* (2013.01)

(58) Field of Classification Search
CPC ..... F02M 25/089; F02M 25/0854
See application file for complete search history.

(56) References Cited

U.S. PATENT DOCUMENTS

2011/0011654 A1* 1/2011 Kubota ..... B60L 50/64 903/903

FOREIGN PATENT DOCUMENTS

JP 2014208518 11/2014

* cited by examiner

*Primary Examiner* — Xiao En Mo
(74) *Attorney, Agent, or Firm* — JCIPRNET

(57) ABSTRACT

A canister disposal structure and a vehicle including the canister disposal structure are disclosed. The canister disposal structure is mounted in the vehicle. The vehicle includes: a secondary power supply providing electricity to a driving electric motor of the vehicle; and a canister adsorbing an evaporative fuel of a fuel tank of the vehicle. The canister disposal structure is configured such that: the canister is disposed below the secondary power supply and is located on a front side of the vehicle relative to the fuel tank.

10 Claims, 5 Drawing Sheets

CANISTER DISPOSAL STRUCTURE AND THE VEHICLE INCLUDING SAME

CROSS-REFERENCE TO RELATED APPLICATION

This application claims the priority benefit of Chinese application no. 202210299530.5, filed on Mar. 25, 2022. The entirety of the above-mentioned patent application is hereby incorporated by reference herein and made a part of this specification.

BACKGROUND

Technical Field

The disclosure relates to a canister disposal structure and a vehicle including the canister disposal structure.

Description of Related Art

In recent years, considering the disadvantaged such as the elderly or children among traffic participants, efforts have been activated in research and development of a sustainable transport system to be provided to the elderly or children for the convenience of use. To achieve the above purpose, devotion is made to development of technology for further improving traffic safety or convenience through research related to improvement of crash safety performance.

In the technology for improving crash safety performance, for example, in Patent Document 1 (Japanese Patent Application Publication No. 2014-208518), a component equipping structure of a hybrid the vehicle is disclosed, where a fuel tank is equipped below the front seat and a canister is equipped below the rear seat to suppress emission of gasoline vapor vaporized from the fuel tank. In addition, a secondary power supply (intelligent power unit, IPU) is equipped at the rear side of the rear seat to supply power to the motor.

However, in the technology for improving crash safety performance, a hybrid the vehicle is equipped with a secondary power supply in addition to a fuel tank and a canister. As a result, a structure that reliably protects the fuel tank, the canister, and the secondary power supply is required in the event of collision. Moreover, it is necessary to protect the fuel tank, the canister, and the secondary power supply from contact with the ground. Furthermore, there is also room for improvement to the location of the canister to effectively protect the fuel tank, the canister, and the secondary power supply.

SUMMARY

According to the technical solution of an embodiment of the disclosure, the disclosure provides a canister disposal structure mounted in a vehicle. The vehicle includes: a secondary power supply providing electricity to a driving electric motor of the vehicle; and a canister adsorbing an evaporative fuel of a fuel tank of the vehicle. The canister disposal structure is configured such that: the canister is disposed below the secondary power supply and is located on a front side of the vehicle relative to the fuel tank.

According to the technical solution of an embodiment of the disclosure, the disclosure also provides a vehicle including the canister disposal structure described above.

DESCRIPTION OF THE EMBODIMENTS

Figure 1:
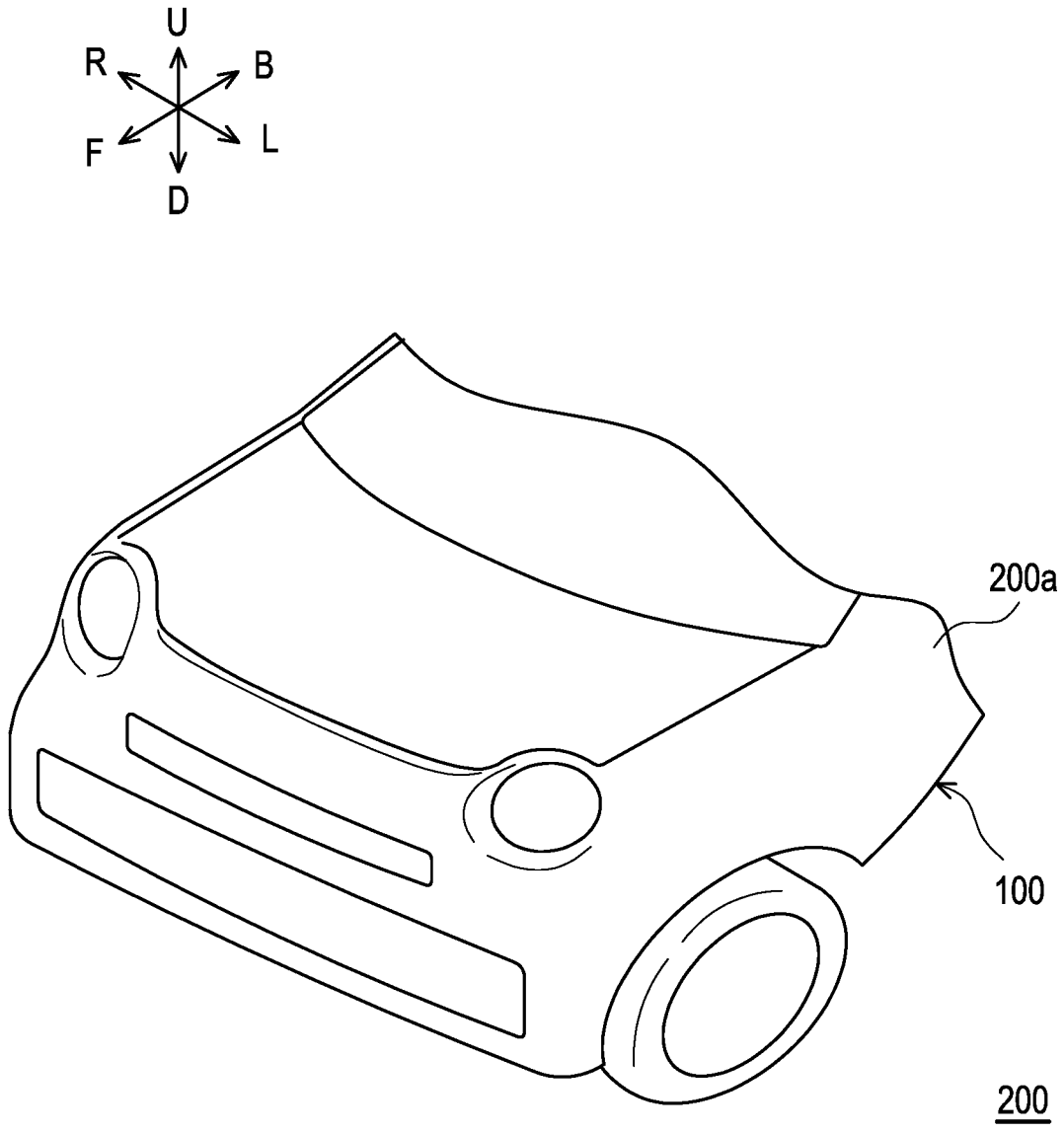
FIG. 1 is a schematic view of a vehicle including a canister disposal structure according to an embodiment of the disclosure.

The disclosure provides a canister disposal structure. By mounting the canister below the secondary power supply (intelligent power unit, IPU), the secondary power supply and the canister may be wrapped in the front-rear direction of the vehicle. In the event of front-rear collision, it is equivalent to disposing the canister in a region for collision protection at the same level with the secondary power supply. In addition, by disposing the plurality of cylindrical members of the canister such that a large size, a medium size, and a small size are arranged in the front-rear direction of the vehicle, the smallest guard member can be used to deal with obstacles generated before and after the chassis of the vehicle is in contact with the ground. As a result, the production efficiency and the productivity of the vehicle can be improved (the layout of the position where the canister is disposed can be improved), which contributes to development of a sustainable transport system.

According to the technical solution of an embodiment of the disclosure, the disclosure provides a canister disposal structure mounted in a vehicle. The vehicle includes: a secondary power supply providing electricity to a driving electric motor of the vehicle; and a canister adsorbing an evaporative fuel of a fuel tank of the vehicle. The canister disposal structure is configured such that: the canister is disposed below the secondary power supply and is located on a front side of the vehicle relative to the fuel tank.

In this way, by disposing the canister below the secondary power supply, the secondary power supply and the canister may be wrapped along the front-rear direction of the vehicle. When collision occurs in the front-rear direction, the canister may be disposed in a region that can provide collision protection at the same level with the secondary power supply. As a result, the productivity of the vehicle can be improved, and the layout of the position where the canister is disposed can be improved.

In an embodiment of the disclosure, the vehicle includes: a floor panel disposed below a vehicle cabin of the vehicle; a side sill disposed on both sides of the floor panel in a width direction of the vehicle and extending along a front-rear direction of the vehicle; a middle cross member extending along the width direction, the middle cross member connected between the side sills and located at a central part of the vehicle; and a rear cross member located at a rear part of the vehicle. The canister disposal structure is configured such that: the canister is disposed in a region between a front wall of the middle cross member and a front wall of the rear cross member.

In this way, by disposing the canister between solid skeletons (i.e., the middle cross member and the rear cross member), the canister can be disposed in a region that can protect the canister from collision from the side of the vehicle. As a result, the productivity of the vehicle can be improved, and the layout of the position where the canister is disposed can be improved.

In an embodiment of the disclosure, the vehicle includes: a guard member disposed in front of the canister and below the canister. The canister includes: a plurality of cylindrical members extending along the width direction; and a package covering the plurality of cylindrical members. The canister is configured such that: the cylindrical member located on the front side of the vehicle has a larger diameter, and the cylindrical member located on a rear side of the vehicle has a smaller diameter.

In this way, by disposing the canister with the cylindrical member having a large diameter near the guard member (e.g., a guard pipe), the large part (i.e., parts that are likely to contact the ground and be affected by scattered gravel) of the canister can be properly protected, and the productivity (maintainability) of the vehicle can be improved.

In an embodiment of the disclosure, the cylindrical member disposed on the rear side of the vehicle is farther from a road surface than the cylindrical member disposed on the front side of the vehicle is.

In this way, with a closer distance of the cylindrical member disposed on the front side of the vehicle to the road surface and a farther distance of the cylindrical member disposed on the rear side of the vehicle to the road surface, the bottom surface of the package of the canister can be inclined toward the front of the vehicle, and the region of the canister that is likely to be affected by scattered objects (e.g., scattered gravel and splash) can be reduced (the front projection area can be reduced). As a result, the productivity (maintainability) of the vehicle can be improved.

In an embodiment of the disclosure, the canister is disposed on one side of a center in a width direction of the vehicle; and the secondary power supply includes a through hole introducing a power supply cable into a vehicle cabin of the vehicle, the through hole being disposed on an opposite side to the canister in the width direction of the vehicle.

In this way, by disposing the canister (gasoline) and the power supply cable (electricity) of the secondary power supply on the left and right sides in the width direction of the vehicle, the inlets and outlets of gasoline and electricity can be disposed separately, improving protection for passengers.

The canister disposal structure and the vehicle including the canister disposal structure of the disclosure, by disposing the canister below the secondary power supply, the secondary power supply and the canister may be wrapped along the front-rear direction of the vehicle. When collision occurs in the front-rear direction, the canister may be disposed in a region that can provide collision protection at the same level with the secondary power supply. As a result, the productivity of the vehicle can be improved, and the layout of the position where the canister is disposed can be improved. In addition, by disposing the canister between solid skeletons (i.e., the middle cross member and the rear cross member), the canister can be disposed in a region that can protect the canister from collision from the side of the vehicle. As a result, the productivity of the vehicle can be improved, and the layout of the position where the canister is disposed can be improved. Furthermore, by disposing the canister with the cylindrical member having a large diameter near the guard member (e.g., a guard pipe), the large part (i.e., parts that are likely to contact the ground and be affected by scattered gravel) of the canister can be properly protected, and the productivity (maintainability) of the vehicle can be improved. Moreover, with a closer distance of the cylindrical member disposed on the front side of the vehicle to the road surface and a farther distance of the cylindrical member disposed on the rear side of the vehicle to the road surface, the bottom surface of the package of the canister can be inclined toward the front of the vehicle, and the region of the canister that is likely to be affected by scattered objects (e.g., scattered gravel and splash) can be reduced (the front projection area can be reduced). As a result, the productivity (maintainability) of the vehicle can be improved. Furthermore, by disposing the canister (gasoline) and the power supply cable (electricity) of the secondary power supply on the left and right sides in the width direction of the vehicle, the inlets and outlets of gasoline and electricity can be disposed separately, improving protection for passengers.

To make the aforementioned more comprehensible, several embodiments accompanied with drawings are described in detail as follows.

Hereinafter, embodiments of the disclosure will be described based on the drawings. It should be noted that, in the embodiments described below, like or corresponding parts are labeled with the same reference numerals and the repeated description will not be omitted. Hereinafter, embodiments of the disclosure will be described with reference to the drawings.

FIG. 1 is a schematic view of a vehicle including a canister disposal structure according to an embodiment of the disclosure. In FIG. 1, a coordinate system of front F, rear B, left L, right R, above U, and below D of a vehicle 200 is indicated. With reference to FIG. 1, the vehicle 200 has a vehicle cabin 200*a*, and a canister disposal structure 100 is disposed in the vehicle 200.

Figure 2:
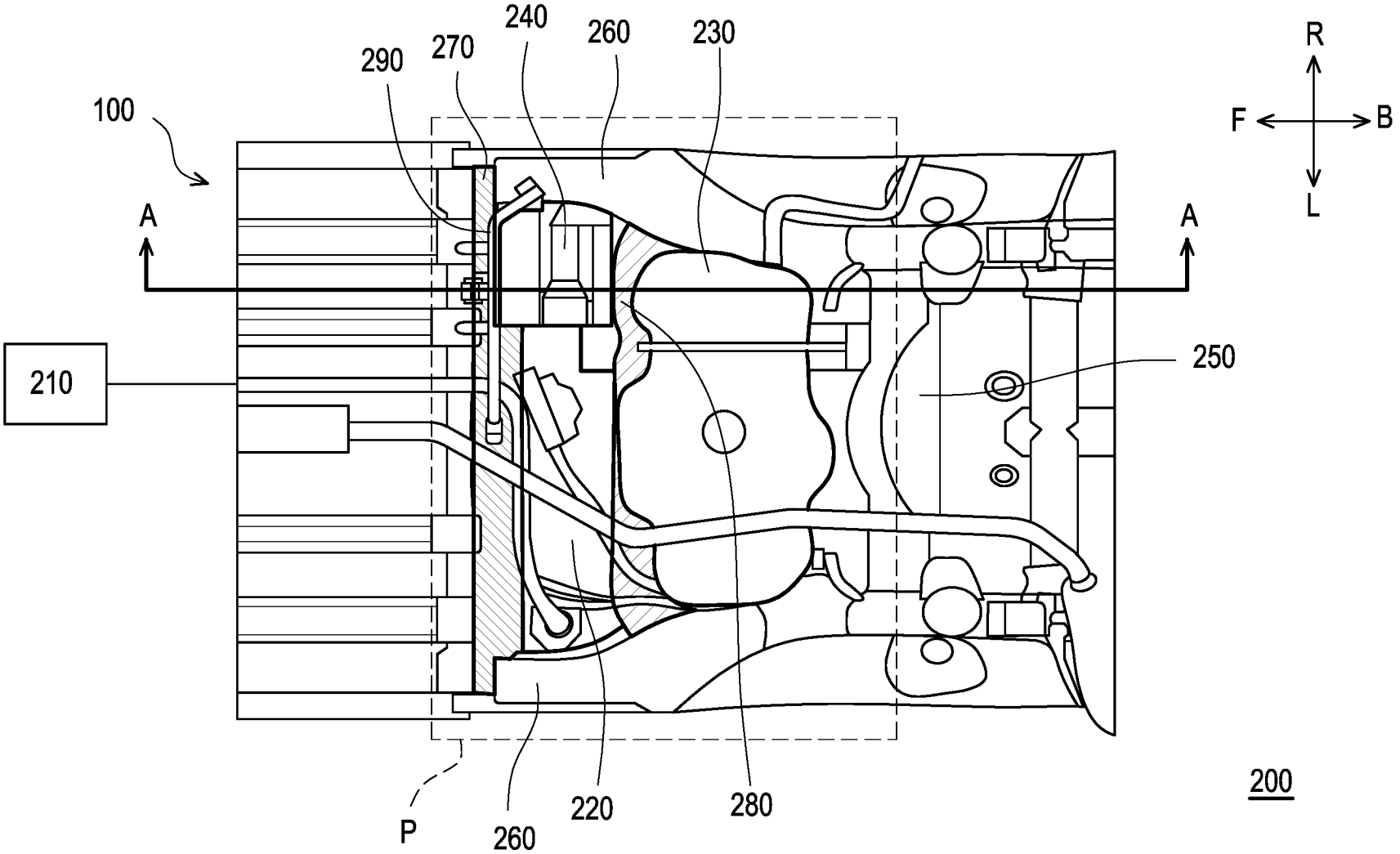
FIG. 2 is a schematic view of the canister disposal structure in FIG. 1 viewed from the below of the vehicle.

FIG. 2 is a schematic view of the canister disposal structure in FIG. 1 viewed from the below of the vehicle. With reference to FIG. 1 and FIG. 2, the canister disposal structure 100 is mounted in the vehicle 200. The vehicle 200 includes: a secondary power supply 220 providing electricity to a driving electric motor 210 of the vehicle 200; and a canister 240 adsorbing an evaporative fuel of a fuel tank 230 of the vehicle 200. The canister disposal structure 100 is configured such that: the canister 240 is disposed below the secondary power supply 220 and located on the front side F of the vehicle 200 relative to the fuel tank 230.

As shown in FIG. 2, the secondary power supply 220, the fuel tank 230, and the canister 240 are disposed in a protection region P configured into the layout that "the canister 240 is disposed below the secondary power supply 220 and located on the front side F of the vehicle 200 relative to the fuel tank 230".

In this way, by disposing the canister 240 below the secondary power supply 220, the secondary power supply 220 and the canister 240 may be wrapped along a front-rear direction F-B of the vehicle 200. When collision occurs in the front-rear direction F-B, the canister 240 may be disposed in a region that can provide collision protection at the same level with the secondary power supply 220. As a result, the productivity of the vehicle 200 can be improved, and the layout of the position where the canister 240 is disposed can be improved.

In FIG. 2, part of the secondary power supply 220 is located above the canister 240 and shielded by the canister 240. With reference to the following FIG. 3, it can be clearly seen that the canister 240 is disposed below the secondary power supply 220. In addition, the canister 240 is disposed in a region for collision protection at the same level with the secondary power supply 220. Moreover, the canister 240 and the secondary power supply 220 are each disposed on the front side F of the fuel tank 230.

Figure 3:
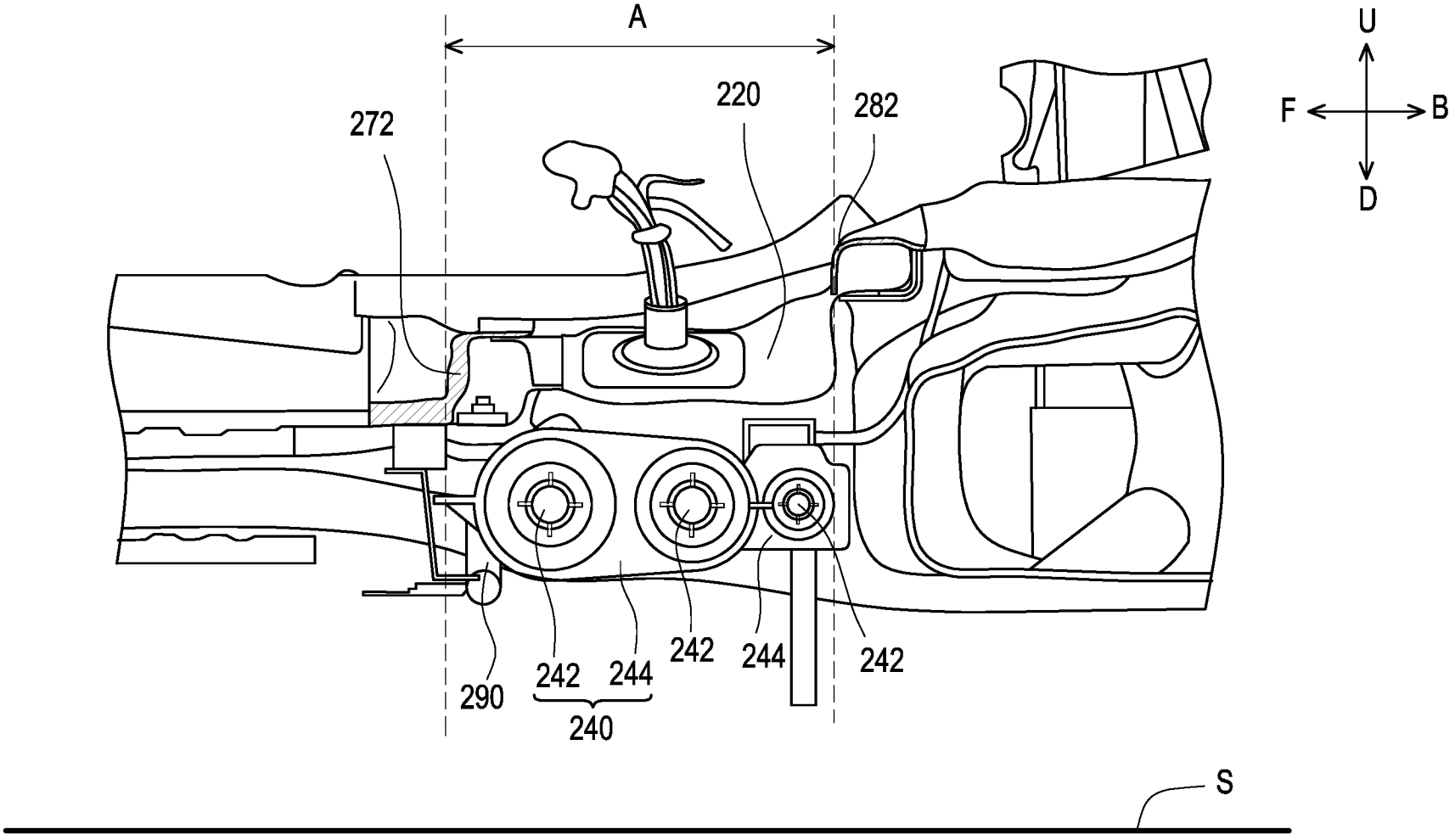
FIG. 3 is a schematic cross-sectional view along line A-A of FIG. 2.

FIG. 3 is a schematic cross-sectional view along line A-A of FIG. 2. With reference to FIG. 1 to FIG. 3, the vehicle 200 may include: a floor panel 250 disposed below the vehicle cabin 200*a* of the vehicle 200; a side sill 260 disposed on both sides of the floor panel 250 in a width direction L-R of the vehicle 200 and extending along the front-rear direction F-B of the vehicle 200; a middle cross member 270 extending along the width direction L-R, the middle cross member 270 connected between the side sills 260 and located at a central part of the vehicle 200; and a rear cross member 280 located at a rear part of the vehicle 200. The canister disposal structure 100 is configured such that: the canister 240 is disposed in a region A between a front wall 272 of the middle cross member 270 and a front wall 282 of the rear cross member 280.

In this way, by disposing the canister 240 between solid skeletons (i.e., the middle cross member 270 and the rear cross member 280), the canister 240 can be disposed in a region that can protect the canister 240 from collision from the side of the vehicle 200. As a result, the productivity of the vehicle 200 can be improved, and the layout of the position where the canister 240 is disposed can be improved.

With reference to FIG. 3, it can be clearly seen that the canister 240 is disposed below the secondary power supply 220. Moreover, the canister 240 is located in the region A protected by the front wall 272 of the middle cross member 270 and the front wall 282 of the rear cross member 280.

With continued reference to FIG. 2 and FIG. 3, the vehicle 200 may include: a guard member 290 disposed in front F (as shown in FIG. 2) of the canister 240 and below D (as shown in FIG. 3) the canister 240. The canister 240 may include: a plurality of cylindrical members 242 extending along the width direction L-R (the direction perpendicular to the paper surface of FIG. 3); and a package 244 covering the plurality of cylindrical members 242. The canister 240 is configured such that: the cylindrical member 242 located on the front side F of the vehicle 200 has a larger diameter, and the cylindrical member 242 located on the rear side B of the vehicle 200 has a smaller diameter.

In this way, by disposing the canister 240 with the cylindrical member 242 having a large diameter near the guard member 290 (e.g., a guard pipe), the large part (i.e., parts that are likely to contact the ground and be affected by scattered gravel) of the canister 240 can be properly protected, and the productivity (maintainability) of the vehicle 200 can be improved.

In FIG. 3, three cylindrical members 242 are shown to present an arrangement of a large diameter, a medium diameter, and a small diameter. Nonetheless, the disclosure does not limit the number of cylindrical members 242, all of which fall within the claim scope of the disclosure as long as the cylindrical member 242 located on the front side F of the vehicle 200 has a larger diameter and the cylindrical member 242 located on the rear side B of the vehicle 200 has a smaller diameter.

Figure 5:
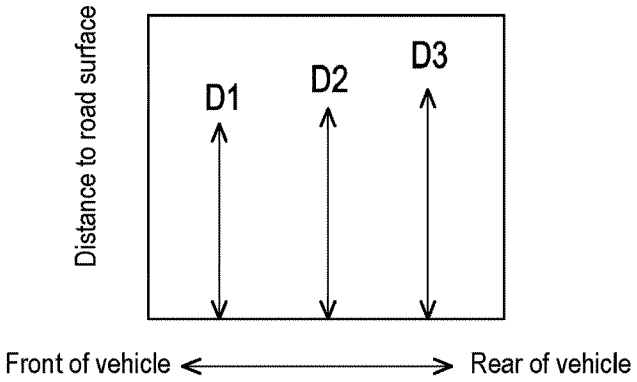
FIG. 5 is a schematic view showing changes in the distances between the road surface and the cylindrical member disposed on the front side of the vehicle and the cylindrical member disposed on the rear side of the vehicle.
Figure 4:
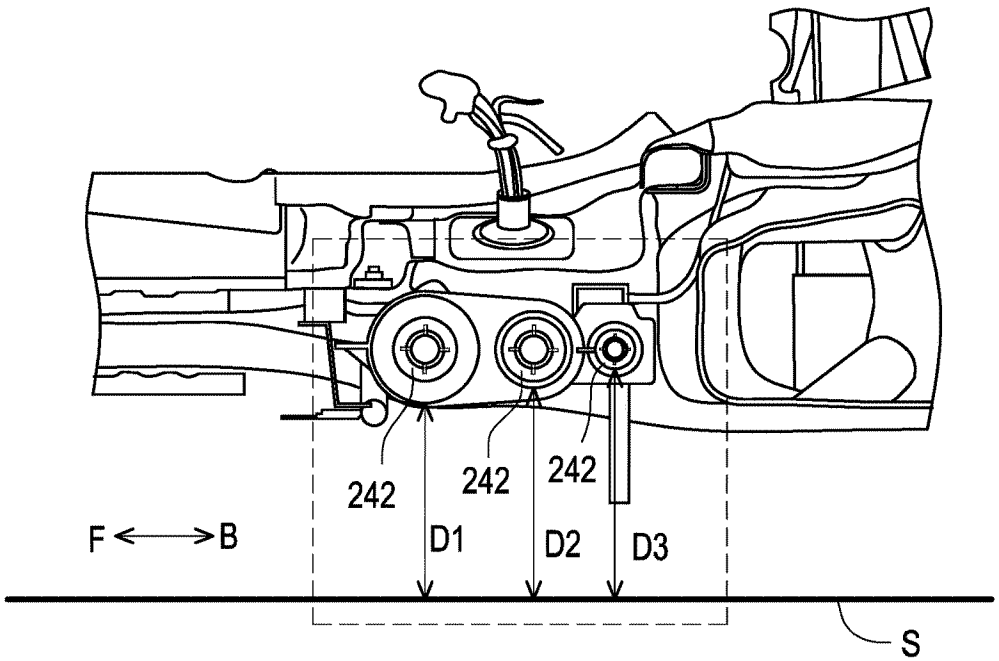
FIG. 4 is a schematic view of distances between the road surface and the cylindrical members disposed on the front side and the rear side of the vehicle.

FIG. 4 is a schematic view of distances between the road surface and the cylindrical members disposed on the front side and the rear side of the vehicle. FIG. 5 is a schematic view showing changes in the distances between the road surface and the cylindrical member disposed on the front side of the vehicle and the cylindrical member disposed on the rear side of the vehicle. In FIG. 5, the horizontal axis represents "the front-rear direction of the vehicle", and the vertical axis represents "the distance between the cylindrical member and the road surface".

With reference to FIG. 3 to FIG. 5, the cylindrical member 242 disposed on the rear side B of the vehicle 200 is farther from a road surface S than the cylindrical member 242 disposed on the front side F of the vehicle 200 is.

To be specific, in FIG. 3, three cylindrical members 242 (having a large diameter, a medium diameter, and a small diameter) are shown to be arranged along the front-rear direction F-B. A distance of the cylindrical member 242 having a large diameter to the road surface is D1, a distance of the cylindrical member 242 having a medium diameter to the road surface is D2, and a distance of the cylindrical member 242 having a small diameter to the road surface is D3. It can be seen from FIG. 4 and FIG. 5 that $D1<D2<D3$.

In this way, with a closer distance of the cylindrical member 242 disposed on the front side F of the vehicle 200 to the road surface S and a farther distance of the cylindrical member 242 disposed on the rear side B of the vehicle 200 to the road surface S, the bottom surface of the package 244 of the canister 240 can be inclined toward the front F of the vehicle 200, and the region of the canister 240 that is likely to be affected by scattered objects (e.g., scattered gravel and splash) can be reduced (the front projection area can be reduced). As a result, the productivity (maintainability) of the vehicle 200 can be improved.

Figure 6:
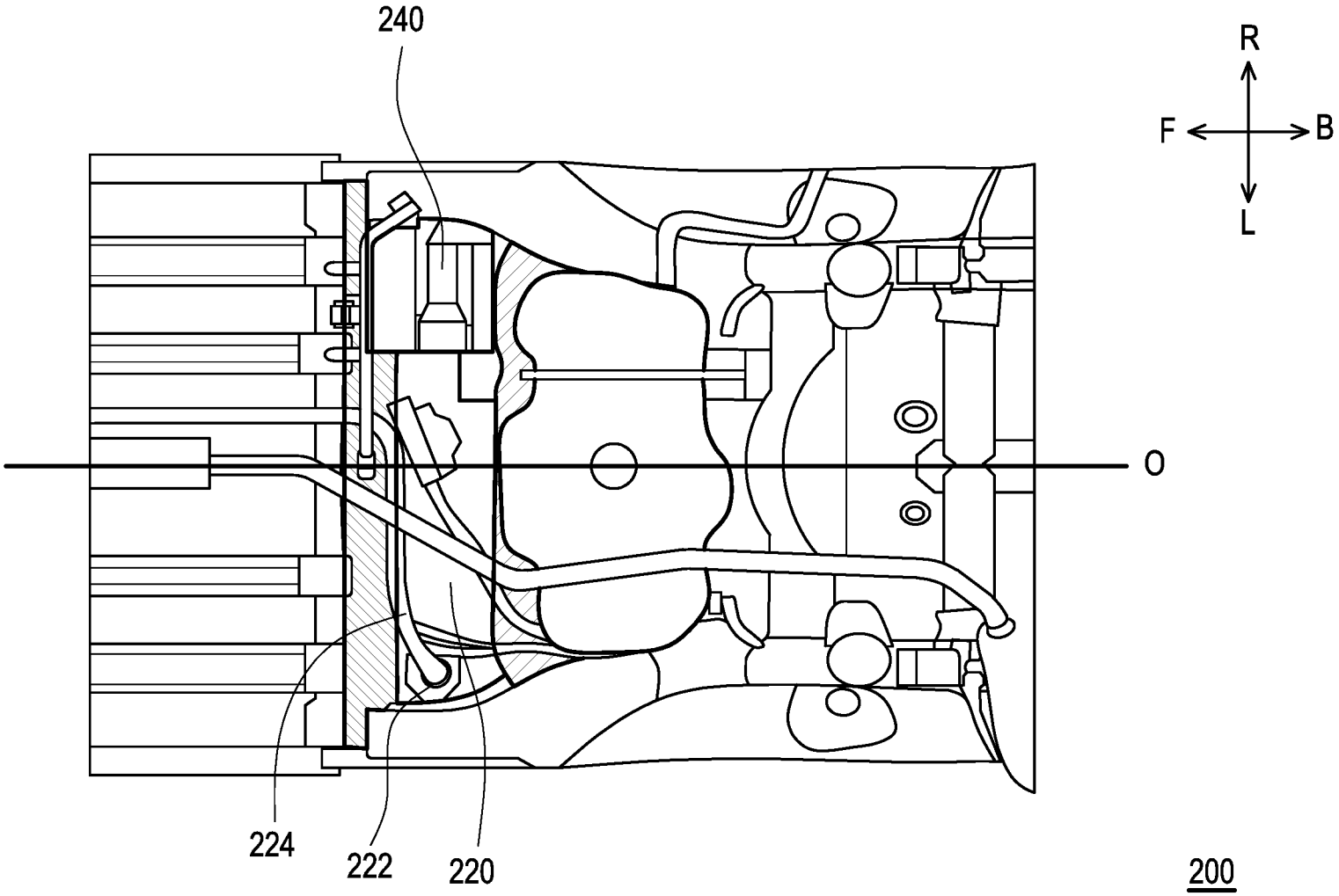
FIG. 6 is a schematic view of the canister disposal structure in FIG. 1 viewed from the below of the vehicle according to another embodiment of the disclosure.

FIG. 6 is a schematic view of the canister disposal structure in FIG. 1 viewed from the below of the vehicle according to another embodiment of the disclosure. With reference to FIG. 6, the canister 240 is disposed on one side of a center O in the width direction L-R of the vehicle 200. The secondary power supply 220 includes a through hole 222 introducing a power supply cable 224 into the vehicle cabin 200*a* of the vehicle 200 (as shown in FIG. 1). The through hole 222 is disposed on an opposite side to the canister 240 in the width direction L-R of the vehicle 200.

In this way, by disposing the canister 240 (gasoline) and the power supply cable 224 (electricity) of the secondary power supply 220 on the left and right sides in the width direction L-R of the vehicle 200, the inlets and outlets of gasoline and electricity can be disposed separately, improving protection for passengers.

In addition, according to the technical solution of an embodiment of the disclosure, the disclosure also provides the vehicle 200 including the canister disposal structure 100.

Based on the foregoing, the canister disposal structure and the vehicle including the canister disposal structure of the disclosure have at least the following technical effects:

By disposing the canister below the secondary power supply, the secondary power supply and the canister may be wrapped along the front-rear direction of the vehicle. When collision occurs in the front-rear direction, the canister may be disposed in a region that can provide collision protection at the same level with the secondary power supply. As a result, the productivity of the vehicle can be improved, and the layout of the position where the canister is disposed can be improved. In addition, by disposing the canister between solid skeletons (i.e., the middle cross member and the rear cross member), the canister can be disposed in a region that can protect the canister from collision from the side of the vehicle. As a result, the productivity of the vehicle can be improved, and the layout of the position where the canister is disposed can be improved. Furthermore, by disposing the canister with the cylindrical member having a large diameter near the guard member (e.g., a guard pipe), the large part (i.e., parts that are likely to contact the ground and be affected by scattered gravel) of the canister can be properly protected, and the productivity (maintainability) of the vehicle can be improved. Moreover, with a closer distance of the cylindrical member disposed on the front side of the vehicle to the road surface and a farther distance of the cylindrical member disposed on the rear side of the vehicle to the road surface, the bottom surface of the package of the canister can be inclined toward the front of the vehicle, and the region of the canister that is likely to be affected by scattered objects (e.g., scattered gravel and splash) can be reduced (the front projection area can be reduced). As a result, the productivity (maintainability) of the vehicle can be improved. Furthermore, by disposing the canister (gasoline) and the power supply cable (electricity) of the secondary power supply on the left and right sides in the width direction of the vehicle, the inlets and outlets of gasoline and electricity can be disposed separately, improving protection for passengers.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A canister disposal structure mounted in a vehicle, the vehicle comprising: a secondary power supply providing electricity to a driving electric motor of the vehicle; and a canister adsorbing an evaporative fuel of a fuel tank of the vehicle, the canister disposal structure being configured such that:

the canister is disposed below the secondary power supply and is located on a front side of the vehicle relative to the fuel tank.

2. The canister disposal structure according to claim 1, wherein the vehicle comprises:

a floor panel disposed below a vehicle cabin of the vehicle;

a side sill disposed on both sides of the floor panel in a width direction of the vehicle and extending along a front-rear direction of the vehicle;

a middle cross member extending along the width direction, the middle cross member connected between the side sills and located at a central part of the vehicle; and a rear cross member located at a rear part of the vehicle, wherein the canister disposal structure is configured such that: the canister is disposed in a region between a front wall of the middle cross member and a front wall of the rear cross member.

3. The canister disposal structure according to claim 2, wherein:

the vehicle comprises a guard member disposed in front of the canister and below the canister;

the canister comprises: a plurality of cylindrical members extending along the width direction; and a package covering the plurality of cylindrical members; and the canister is configured such that: the cylindrical member located on the front side of the vehicle has a larger diameter, and the cylindrical member located on a rear side of the vehicle has a smaller diameter.

4. The canister disposal structure according to claim 3, wherein the cylindrical member disposed on the rear side of the vehicle is farther from a road surface than the cylindrical member disposed on the front side of the vehicle is.

5. The canister disposal structure according to claim 1, wherein:

the canister is disposed on one side of a center in a width direction of the vehicle; and the secondary power supply comprises a through hole introducing a power supply cable into a vehicle cabin of the vehicle, the through hole being disposed on an opposite side to the canister in the width direction of the vehicle.

6. A vehicle comprising:

a canister disposal structure mounted in the vehicle;

a secondary power supply providing electricity to a driving electric motor of the vehicle; and a canister adsorbing an evaporative fuel of a fuel tank of the vehicle, wherein the canister disposal structure is configured such that: the canister is disposed below the secondary power supply and is located on a front side of the vehicle relative to the fuel tank.

7. The vehicle according to claim 6, further comprising:

a floor panel disposed below a vehicle cabin of the vehicle;

a side sill disposed on both sides of the floor panel in a width direction of the vehicle and extending along a front-rear direction of the vehicle;

a middle cross member extending along the width direction, the middle cross member connected between the side sills and located at a central part of the vehicle; and a rear cross member located at a rear part of the vehicle, wherein the canister disposal structure is configured such that: the canister is disposed in a region between a front wall of the middle cross member and a front wall of the rear cross member.

8. The vehicle according to claim 7, further comprising: a guard member disposed in front of the canister and below the canister;

wherein the canister comprises: a plurality of cylindrical members extending along the width direction; and a package covering the plurality of cylindrical members; and the canister is configured such that: the cylindrical member located on the front side of the vehicle has a larger diameter, and the cylindrical member located on a rear side of the vehicle has a smaller diameter.

9. The vehicle according to claim 8, wherein the cylindrical member disposed on the rear side of the vehicle is farther from a road surface than the cylindrical member disposed on the front side of the vehicle is.

10. The vehicle according to claim 6, wherein:

the canister is disposed on one side of a center in a width direction of the vehicle; and the secondary power supply comprises a through hole introducing a power supply cable into a vehicle cabin of the vehicle, the through hole being disposed on an opposite side to the canister in the width direction of the vehicle.

* * * * *